United States Patent [19]

Windham

[11] Patent Number: 4,600,250

[45] Date of Patent: Jul. 15, 1986

[54] SECURITY STAND

[75] Inventor: Bob E. Windham, Garland, Tex.

[73] Assignee: Windham Manufacturing Company, Dallas, Tex.

[21] Appl. No.: 564,935

[22] Filed: Dec. 23, 1983

[51] Int. Cl.[4] ..... A47B 21/00; E05G 1/00; A47G 29/00

[52] U.S. Cl. ..... 312/208; 109/50; 248/1

[58] Field of Search ..... 312/196, 208, 278; 108/92; 109/51, 50; 248/1 A

[56] References Cited

U.S. PATENT DOCUMENTS

| | | | |
|---|---|---|---|
| 2,090,176 | 8/1937 | Besancom | 108/92 |
| 3,862,785 | 1/1975 | Scheerhorn | 312/196 |
| 4,313,112 | 1/1982 | Foster | 248/442.2 |

FOREIGN PATENT DOCUMENTS

| | | | |
|---|---|---|---|
| 368507 | 3/1932 | United Kingdom | 109/51 |

*Primary Examiner*—William E. Lyddane
*Assistant Examiner*—Gerald A. Anderson
*Attorney, Agent, or Firm*—G. Roland Love

[57] ABSTRACT

A security stand having a horizontal mounting surface, first and second sides of a width lesser than the depth of the horizontal mounting surface, a top surface extending between the two sides and a lipped shelf extending between the first and second sides and between the horizontal mounting surface and the top surface. The shelf with the lipped edge is mounted in a secure fashion such that equipment mounted or resting therein cannot be removed without removing the shelf. The horizontal mounting surface has means for attaching a computer keyboard prior to mounting the horizontal mounting surface onto a table such that the keyboard may not be removed. Additionally, secure mounting means may be provided in the top surface for mounting a Cathode Ray Tube before insertion of the lipped shelf and equipment therein.

2 Claims, 1 Drawing Figure

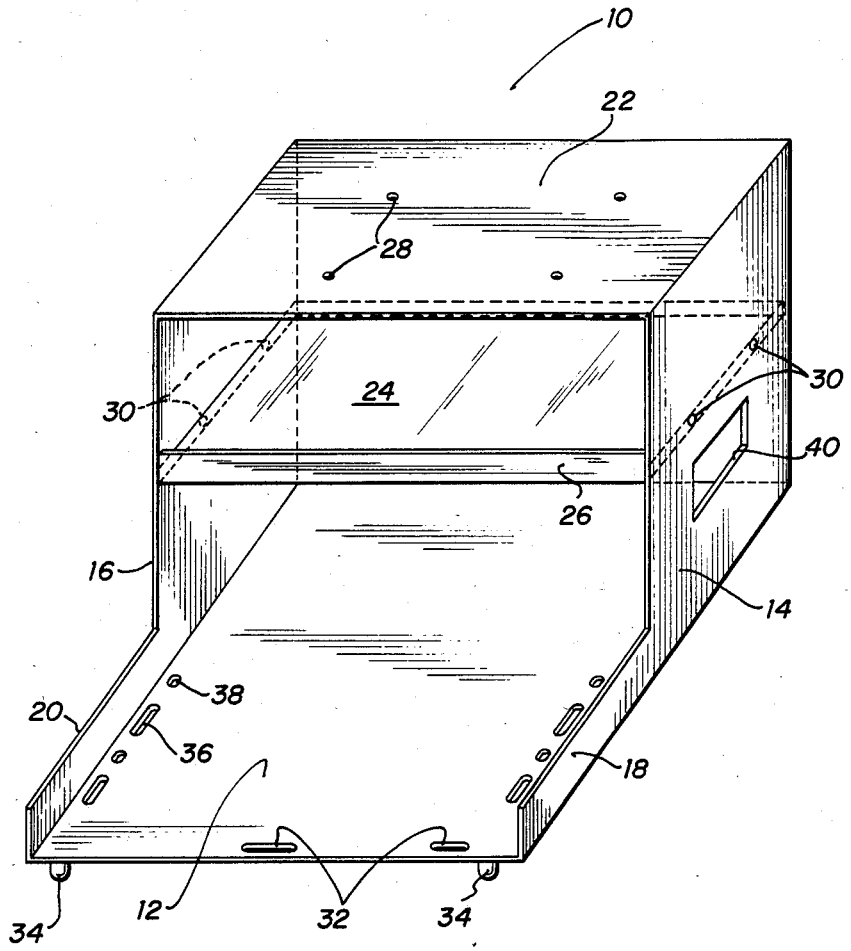
10
22
28
24
30
30
40
26
16
14
38
20
36
18
12
32
34
34

SECURITY STAND

TECHNICAL FIELD

The present invention relates to a security stand for securely mounting computer equipment, primarily for use in educational or other instructive modes.

BACKGROUND OF THE INVENTION

The present invention relates to a security stand which is primarily used in educational and other instructive situations. For instance, it is becoming quite prevalant in the schools to provide instruction in the use of a computer. However, securely mounting computer equipment to prevent theft or misuse of the equipment has been a problem. There has been at least one other attempt by an entity known as EPI at a computer stand having a shelf supported by disc spacers extending from the top surface and having a lip which extends downward from the shelf towards the mounting surface on the front edge and extending upwards towards the top surface on the rear edge. This computer stand does not provide the security and inability to remove items on the shelf as provided by the present invention.

SUMMARY OF THE INVENTION

The present invention provides a security stand for mounting computer equipment but which prohibits their easy removal. The shelf is constructed in a manner which prevents removal of equipment on the shelf and removal of a CRT which may be supported by the top surface but which is fastened from underneath. Further, the keyboard mounted to the horizontal mounting surface cannot be removed without removing the entire security stand from the table to which it is mounted.

These and other objects of the present invention will be apparent from the detailed description below.

BRIEF DESCRIPTION OF THE DRAWINGS

FIG. 1 is a perspective view of the security stand.

DETAILED DESCRIPTION

Referring now to FIG. 1, a perspective view of the security stand 10 is shown. The security stand includes a horizontal mounting surface 12 having first vertically extending side 14 and a second vertically extending side 16. The width of the vertically extending sides is identical but of lesser width than the depth of the horizontal mounting surface 12. The first and second vertically extending sides may have a small extension 18 and 20 extending from the remaining depth of the horizontal mounting surface 12 along the forward edge of the sides of the horizontal mounting surface 12 and extending a short distance vertically from the horizontal mounting surface 12.

A top surface 22 extends between the remaining edges of the first and second vertically extending sides 14 and 16 to provide an open front and rear side enclosure. A shelf 24 is mounted between the vertically extending sides 14 and 16 and beneath the top surface 22 and above the horizontal mounting surface 12 to provide a shelf within the front and rear open sided enclosure. A vertically extending lip 26 is provided on the front and rear of the shelf 24 to prevent removal of components residing on the shelf once the shelf is installed.

Additionally, the top surface 22 may be provided with mounting holes 28 to which a Cathode Ray Tube may be mounted to sit on top of the top surface 22. The mounting means extend from beneath the top surface 22 and may not be reached when the shelf 24 is in place. The shelf 24 may preferably be mounted between the first and second vertically extending sides 14 and 16 by means of security screws which may only be removed by a pronged tool which may be ordered with the security screws 30.

Slots 32 are provided along the front edge of the horizontal mounting surface 12 to mount a computer keyboard from underneath. Standoffs 34 prevent cuts into the table to which the security stand 10 is mounted. Finally, slots 36 and holes 38 are provided along the edge of the horizontal mounting surface 12 to provide a mounting means to a table such that the security stand may not be removed easily.

An air vent 40 may be provided in one or both sides of the vertically extending sides 14 and 16 for cooling the computer components. Exhaust fans available on the market can be mounted in the vent hole 40.

It will be appreciated by those skilled in the art that other embodiments of the present invention may be constructed based on disclosure herein. The foregoing descriptions of the preferred embodiment has been by way of example. Therefore, the scope of the present invention is being limited only by the claims below.

What is claimed is:

1. A security stand for a computer system including a keyboard, disc drive, and CRT comprising:

a horizontal mounting surface for attachment to a table top, having a plurality of slots and holes for attaching a computer keyboard to the top of the horizontal mounting surface by attachment means inserted through the slots and holes from the bottom of the horizontal mounting surface through to the computer keyboard and which keyboard attachment means are not accessible when the horizontal mounting surface is attached to a table top;

a first side extension, having a width less than the depth of the horizontal mounting surface, connected to and extending vertically from a first edge of the horizontal mounting surface;

a second side extension connected to and extending vertically from a second edge of the horizontal mounting surface parallel to and opposite the first side extension;

a top horizontal surface connected between the remaining ends of the first and second side extensions to form a front and rear open-sided enclosure and to support a CRT attached to the top horizontal surface by attachment means extending through the top horizontal surface from underneath the top horizontal surface;

a separately installed horizontal support attached between the first and second side extensions and beneath the top surface, by attachment means which are not readily unattached, to support one or more disc drives and to prevent access to the CRT attachment means and the rear portion of the keyboard attached to the horizontal mounting surface; and a lip extending vertically from the front and rear edges of the horizontal support to prevent removal of the disc drives without removing the horizontal support.

2. The Security Stand of claim 1 further comprising:

a series of holes and slots near the front and rear edges of the horizontal mounting surface for attachment to a table;

standoffs attached to the bottom of the horizontal mounting surface to prevent scratches and cuts to the table on which the horizontal mounting surface is attached;

an air vent in at least one of the vertical side extensions and into which a fan may be installed;

holes or slots in the top horizontal surface for mounting the CRT; and, attachment means for the horizontal support comprising one-way security screws to securely attach the horizontal support between the first and second vertical extensions.

* * * * *